US006098582A

United States Patent [19]

Araki

[11] Patent Number: 6,098,582

[45] Date of Patent: Aug. 8, 2000

[54] FOUR-STROKE CYCLE INTERNAL COMBUSTION ENGINE

[75] Inventor: Tsuneo Araki, Hinode-machi, Japan

[73] Assignee: Kioritz Corporation, Tokyo, Japan

[21] Appl. No.: 09/158,153

[22] Filed: Sep. 22, 1998

[30] Foreign Application Priority Data

Sep. 25, 1997 [JP] Japan ..... 9-259872

[51] Int. Cl.[7] ..... F01B 23/06; F01L 1/06

[52] U.S. Cl. ..... 123/90.31; 123/90.27; 123/193.3

[58] Field of Search ..... 123/90.27, 90.31, 123/90.6, 193.3, 193.5, 195 HC

[56] References Cited

U.S. PATENT DOCUMENTS

| | | | |
|---|---|---|---|
| 4,836,156 | 6/1989 | Inagaki et al. | 123/90.31 |
| 5,579,735 | 12/1996 | Todero et al. | 123/317 |
| 5,606,943 | 3/1997 | Tamba et al. | 123/90.23 |
| 5,606,944 | 3/1997 | Kurihara | 123/90.31 |
| 5,704,315 | 1/1998 | Tsuchida et al. | 123/90.16 |
| 5,706,769 | 1/1998 | Shimizu | 123/90.23 |

FOREIGN PATENT DOCUMENTS 0779412 6/1997 European Pat. Off. .

*Primary Examiner*—Weilun Lo

*Attorney, Agent, or Firm*—Jacobson, Price, Holman & Stern, PLLC

[57] ABSTRACT

A four-stroke cycle internal combustion engine allowing simplified assembly, high productivity, and still high precision in assembly is made up of a crankshaft; a camshaft; a gear train for transmitting the rotation of the crankshaft to the camshaft; and a housing block. The housing block includes a cylinder portion with the gear train disposed in a longitudinal direction along the cylinder portion. The housing block further includes a bearing portion for supporting the crankshaft, an upper outer wall portion extending vertically downward from the cylinder portion to the bearing portion and a longitudinally oriented gear case for housing the gear train. The housing block is divided into a cylinder block main body part and a cylinder block lower part at the bearing portion of the crankshaft. The cylinder block body portion includes an integrally formed cylinder portion, upper outer wall portion and gear case.

12 Claims, 4 Drawing Sheets

FOUR-STROKE CYCLE INTERNAL COMBUSTION ENGINE

BACKGROUND OF THE INVENTION

The present invention relates to a four-stroke cycle internal combustion engine, and in particular, to a four-stroke cycle internal combustion engine which is equipped with an OHC valve drive mechanism and is suitable to be used for a portable working machine, or the like.

DESCRIPTION OF THE PRIOR ART

Recently, there is an increasing demand for utilizing four-stroke cycle internal combustion engines for portable working machines such as a portable trimmer, a chain saw, or the like, in order to reduce noise and produce cleaner burnt gas exhaustion.

Typically, a conventional four-stroke cycle internal combustion engine comprises a cylinder part, a crankcase part, a camshaft support part, etc., each of which is formed separately. One of the reasons for this is as follows. In the case of an OHV type four-stroke cycle internal combustion engine, it comprises a push rod for driving rocker arms which opens and closes inlet and outlet valves. Further, in the case of the OHC type four-stroke cycle internal combustion engine, it comprises an endless belt for transmitting the rotation of the crankshaft to the camshaft and a belt tensioning mechanism for the endless belt. Therefore, the engine has to be constructed in such a way that the push rod, the endless belt and the belt tensioning mechanism can be assembled therein.

On the other hand, increasing the number of parts in an engine results in accumulated errors in measures. Further, it takes longer to assemble. Finally, high manufacturing precision is required to obtain proper alignment between mating faces, and rotatable shafts, and accurate parallelism between the shafts.

The object of the present invention is to provide a four-stroke cycle internal combustion engine which enables a simplified assembly process, allows higher productivity, and still provides precision assembly.

SUMMARY OF THE INVENTION

The above described object of the present invention can be achieved by a four-stroke cycle OHC type internal combustion engine, comprising: a crankshaft; a camshaft; a gear train for transmitting the rotation of the crankshaft to the camshaft; a housing block, the housing block including a cylinder portion, the gear train being disposed in a longitudinal direction along the cylinder portion, the housing block further including a bearing portion for supporting the camshaft, an upper outer wall portion extending vertically downward from the cylinder portion to the bearing portion and a longitudinally oriented gear case for housing the gear train; and the housing block being divided into a cylinder block main body part and a cylinder block lower part at the bearing portion of the crankshaft, the cylinder block body portion including an integrally formed cylinder portion, upper outer wall portion and gear case.

The four-stroke cycle internal combustion engine of the present invention is assembled as follows. The cylinder block main body part and the cylinder block lower part are connected to each other with the crankshaft placed therebetween. Then the gear composing the gear train is installed from the opened end of the gear case and finally the camshaft and the camshaft gear are installed into the upper portion of the cylinder portion.

The present invention allows a simpler assembly and makes it unnecessary to machine mate faces because the cylinder portion, the upper outer wall portion, and the gear case are integrally formed. Further, in the four-stroke cycle internal combustion engine of the present invention, the rotation of the crankshaft is transmitted to the camshaft through the gear train. The gear train can be assembled by inserting gears one-by-one into the gear case extending longitudinally, the assembly into an area which is hardly accessible can be easily done even though the cylinder portion, the upper outer wall portion and the gear case are integrally formed.

According to an embodiment of the present invention, the engine is of an air-cooled type. Therefore, no cooling water channel is required in the cylinder block main body part and it makes it easier to form it integrally.

According to an embodiment of the present invention, the cylinder block main body part further has a camshaft support portion for supporting the camshaft, the camshaft support portion is integrally formed therewith above the cylinder portion, the camshaft support portion has a lateral hole which defines at least a pair of camshaft bearings; the gear case has a gear installation opening for receiving gears constituting the gear train; and the lateral hole opens toward the gear installation opening. In the embodiment of the present invention, since the lateral hole opens toward the gear installation opening, an assembly space is formed in the area which makes it easy to insert the camshaft into the lateral hole and to assemble gears composing the gear train.

Further, according to an embodiment of the present invention, the camshaft bearing which is located closer to the gear installation opening is large enough to allow cam portions of the camshaft to pass through; and the camshaft has a large diameter support portion to be supported by the camshaft bearing. In the embodiment of the present invention, the cams can be integrally formed with the camshaft and the camshaft can be assembled by merely inserting the camshaft into the camshaft bearing of the camshaft support portion, thus simplifying the assembly process.

Further, according to an embodiment of the present invention, rotational axes of the crankshaft, the camshaft, and the respective gears of the gear train extend parallel to each other; and the cylinder block main body part has parallel holes formed therein to receive the crankshaft, the camshaft, and supporting shafts of the gears. This assures the precise location of the shafts in parallel to each other without post machining processing. Further, the noise caused by excessive play among the gears of the gear train can be reduced.

DESCRIPTION OF THE PREFERRED EMBODIMENTS

Now, referring to the attached drawings, a preferred embodiment shall be described in detail taking a portable trimmer as an example of a portable working machine.

Figure 1:
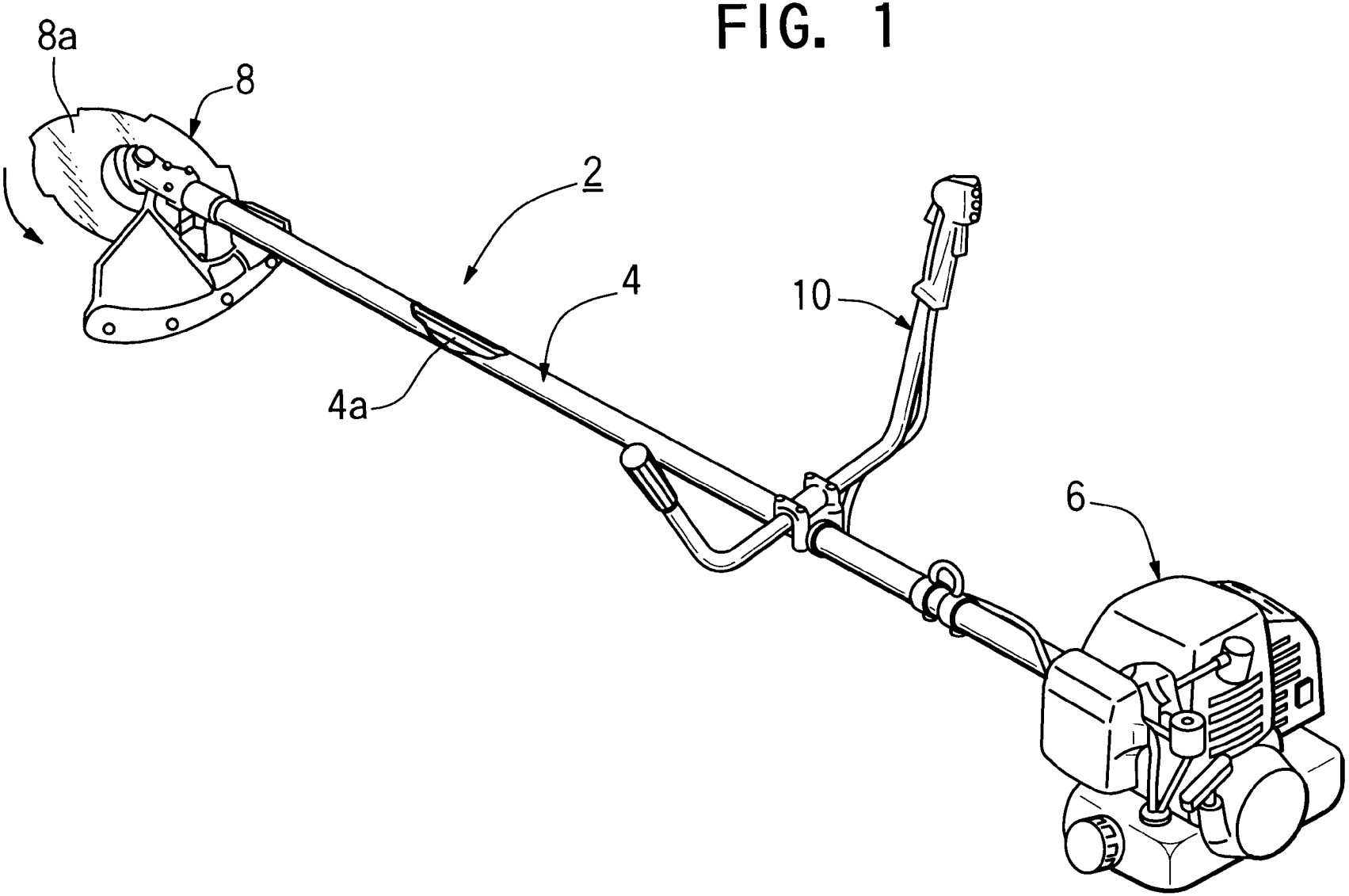
FIG. 1 is an overall perspective view of a portable trimmer.

As shown in FIG. 1, the portable trimmer 2 includes a supporting tube 4 which has a power transmitting shaft 4*a* inserted therein, a four-stroke cycle internal combustion engine 6 at its rear end, and a working section 8 at its front end. The working section 8 is equipped with a cutting blade 8*a* for trimming weeds which rotates in a direction indicated by the arrow. The rotational force from the four-stroke cycle internal combustion engine 6 is transmitted through a centrifugal clutch (not illustrated) to the power transmitting shaft 4*a* to rotate the cutting blade 8*a*. An operator holds a handle section provided at the middle of the supporting tube 4 by both hands.

Figure 2:
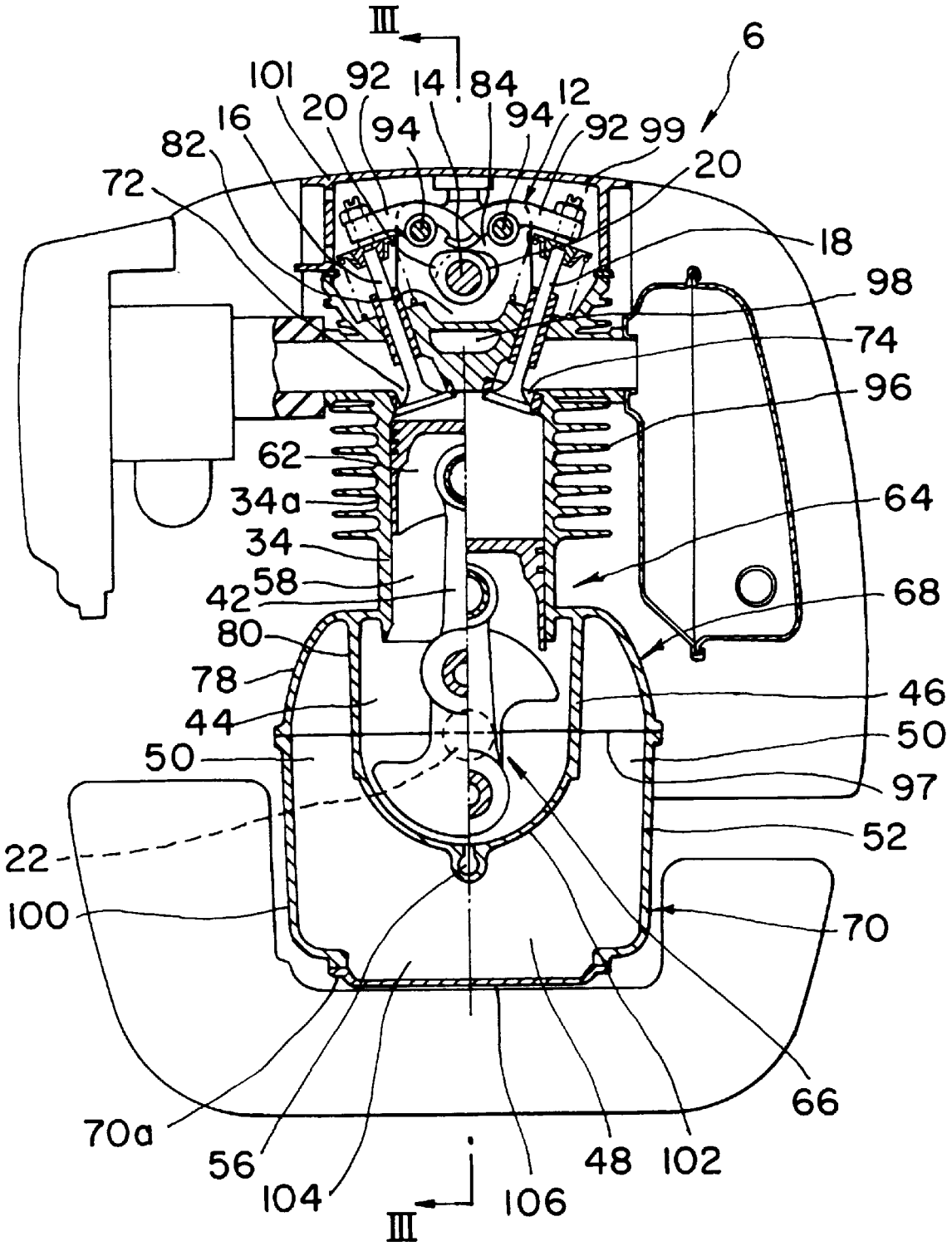
FIG. 2 is a cross-sectional view of a four-stroke cycle internal combustion engine according to the present embodiment taken along a line II—II shown in FIG. 3.
Figure 3:
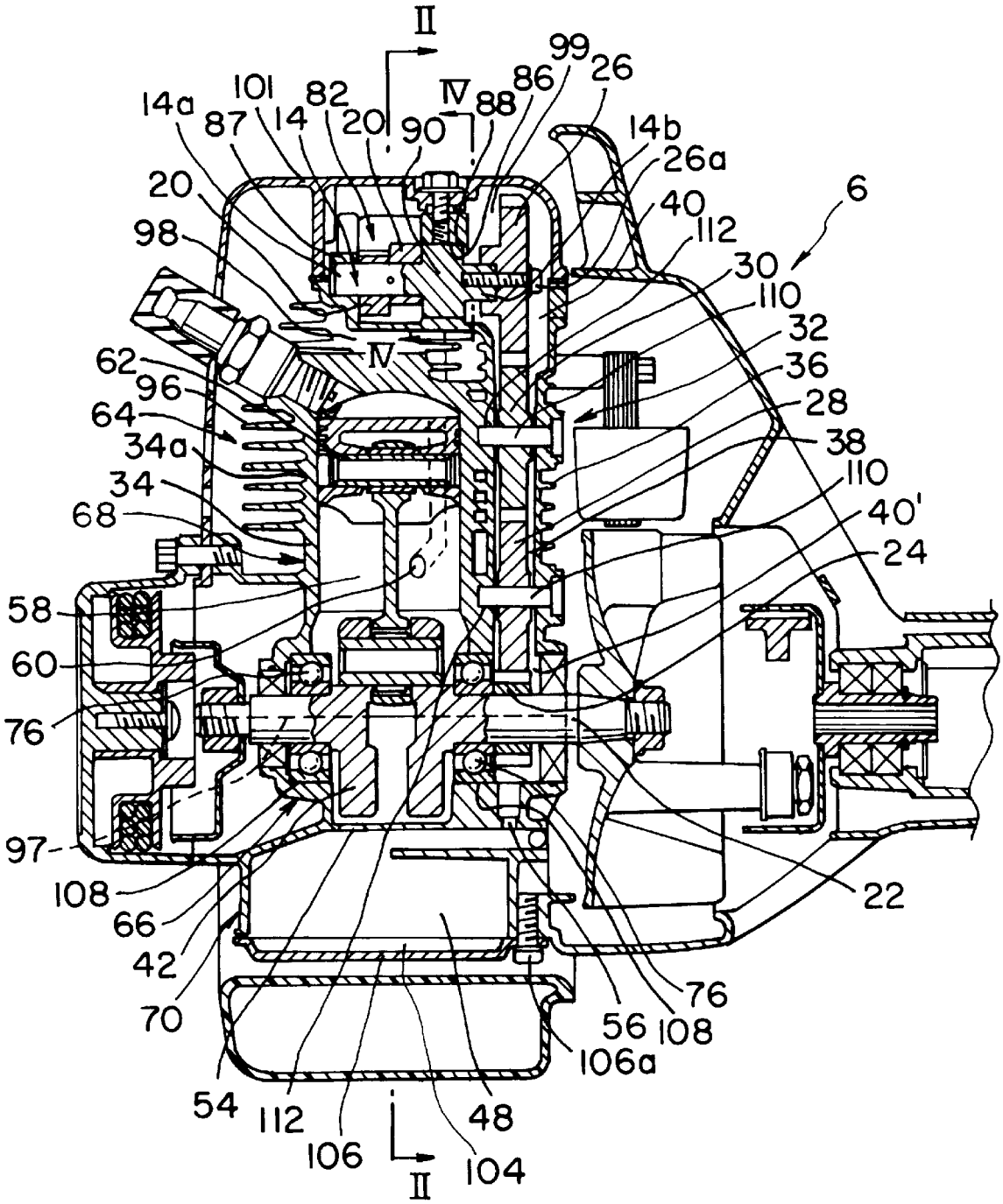
FIG. 3 is a cross-sectional view of a four-stroke cycle internal combustion engine according to the present embodiment taken along a line III—III shown in FIG. 2.

The four-stroke cycle internal combustion engine 6 of the present embodiment shown in FIGS. 2 and 3, is of an air-cooling type and has a SOHC type valve drive mechanism 12. It is provided with a camshaft 14 having two cam portions 20, 20, one for an inlet valve 16 and the other for an exhaust valve 18. As can be seen in FIG. 3, a crankshaft 22 is equipped with a crank gear 24 and the camshaft 14 is equipped with a cam gear 26. Two intermediate gears 28, 30 are intervened between the crank gear 24 and the cam gear 26. The camshaft 14 is rotated synchronously with respect to the crankshaft 22 by a gear train 32 constituted as stated above. The gear train 32 is disposed vertically straight along the cylinder portion 34 in front thereof, that is, the side toward the cutting blade 8*a*. The gear train 32 is housed in a gear chamber 38 in a gear case 36 arranged in front of the cylinder portion 34. The gear chamber 38 extends vertically straight along the front surface of the cylinder portion 34 and has an upwardly opening, gear installation opening 40.

As shown in FIG. 2, the four-stroke cycle internal combustion engine 6 has an inner wall 46 surrounding a connecting rod 42 on both left and right sides and lower side thereof to form a crankcase 44, and an outer wall 52 which surrounds the inner wall 46 with upper ends thereof connected to the inner wall 46 so as to form an oil reserving area 48 below the crankcase 44 and oil recess areas 50 on both sides of the crankcase 44. A slit 54 is formed in the inner wall 46 to introduce oil mist from the oil reserving area 48 into the cylinder portion 34. The four-stroke cycle internal combustion engine 6 of the portable trimmer 2 according to the present embodiment sometimes takes a tilted or upside down position when an operator cuts weeds located at a height more than the operator's waist or branches above the operator's head by the cutting blade 8*a*. In such a case, the oil stored in the oil reserving area 48 located below the crankcase 44 flows into the oil recess areas 50 located on both sides of the crankcase 44 to prevent excess oil from flowing into the crankcase 44 through the slit 54. As also can be seen in FIGS. 2 and 3, the oil mist suction port 56 is provided on a surface toward the oil reserving area of the inner wall 46 to introduce the oil mist from the oil reserving area 48 so that the gear train 32 and the valve drive mechanism 12 can be lubricated. The oil mist suction port 56 communicates with the gear chamber 38 and a cam chamber 99 which are sealingly formed by a detachable cylinder head cover 101 in which the valve drive mechanism 12 is provided. It further communicates with an oil mist discharge port 60 which opens toward the inside of a cylinder bore 58. The oil mist is supplied from the oil reserving area 48 to the gear train 32 and the valve drive mechanism 12 by the pressure change created by the up-and-down movement of a piston 62.

As shown in FIG. 2, an engine main body 64 of the four-stroke cycle internal combustion engine 6 of the present embodiment is divided into two parts which include a cylinder block main body part 68 and cylinder block lower part 70. They are separated along the horizontal parting line 97 going through the bearing portion 66 of the crankshaft 22. Each part is integrally formed by an aluminum alloy die-casting process. The cylinder block main body part 68 comprises the cylinder portion 34 which has the cylinder bore 58 formed therein, an inlet port 72 and an exhaust port 74 formed at its top, an upper outer wall portion 78 and an upper inner wall portion 80 which extend vertically down from the lower portion of the cylinder portion 34 to ball bearings 76 for supporting the crankshaft 22 to form an upper portion of the crankcase 44 and an upper portion of the oil recess areas 50, and a camshaft support portion 82 and a rocker shaft support portion 84 above the cylinder portion 34. They are integrally connected to each other.

A lateral hole 86 for inserting the camshaft 14 is formed in the camshaft support portion 82 provided above the cylinder portion 34. The lateral hole 86 extends parallel to the axis of the crankshaft 22 and opens toward the gear installation opening 40 in the gear chamber 38. As shown in FIG. 3, at the innermost portion of the lateral hole 86, a rear camshaft bearing 87 is formed to support the rear end 14*a* of the camshaft 14. To enable installation of the camshaft 14 with two cams 20, 20 for the inlet valve 16 and the exhaust valve 18, respectively, into the camshaft support portion 82, the front camshaft bearing 88 formed in the camshaft support portion 82 defines the lateral hole 86 with a diameter which is large enough for the cams 20 to pass through. The camshaft 14 has a large diameter support portion 90 at an axial location corresponding to the front camshaft bearing 88 to be supported by the front camshaft bearing 88. The diameter of the large diameter support portion 90 is nearly equal to that of the front camshaft bearing 88. The cam gear 26 is fixed by a screw 26*a* on the axis of the camshaft 14 at the front end 14*b* of the camshaft 14.

Further, as shown in FIG. 2, at an upper portion of the camshaft support portion 82, the rocker shaft support portion 84 is integrally formed. The rocker shaft support portion 84 with two rocker shafts 94 attached thereto is for mounting two rocker arms 92 in such a manner to allow them to swing.

As previously described, the four-stroke cycle internal combustion engine 6 of the present embodiment is of the air-cooled type and has many integrally formed heat radiation fins 96 around the outer surface 34*a* of the cylinder portion 34. Further, as shown in FIGS. 2 and 3, an air-cooling lateral hole 98 is formed between the cylinder portion 34 and the camshaft support portion 82 to cool a top portion of the cylinder portion 34 where heat accumulates.

On the other hand, the cylinder block lower portion 70 has an integrally formed lower outer wall portion 100 and an integrally formed lower inner wall portion 102 which defines a closed space together with the upper outer wall portion 78 and the upper inner wall portion 80. That is, the crankcase 44 is formed below the cylinder bore 58, the oil recess areas 50 are formed on both right and left sides of the crankcase 44, and the oil reserving area 48 is formed therebelow. At a bottom portion 70*a* of the cylinder block lower part 70, an opening 104 for removing a mold, hereafter referred to as a mold removing opening, is formed so that a dual-wall structure including the lower outer wall portion 100 and the lower inner wall portion 102 can be formed by a molding process. The molding removing opening 104 is closed by a lid member 106 made of an aluminum alloy plate whose thickness is nearly the same as the wall thickness of the cylinder block lower part 70. The lid member 106 is fixed to the lower outer wall portion 100 by screws 106*a* to form the oil reserving area 48 as described above.

Further, at the horizontal parting line 97 where the cylinder block main body part 68 and the cylinder block lower part 70 mate, semi-circle bearing receiving holes 108 are formed to install the ball bearings 76 for supporting the crankshaft 22. Further, at the outer wall of the gear case 36 defining the gear chamber 38, gear shaft support bearings 112 are formed so that two gear support shafts 110 supporting the two intermediate gears 28, 30 can be laterally inserted.

The four-stroke cycle internal combustion engine 6 of the present embodiment constituted as stated above is assembled as follows.

First, a worker inserts his/her hands into an assembly space 40' located above the parting line 97 and inserts the lower intermediate gear 28 through the gear installation opening 40 in the gear chamber 38 and then, inserts the gear support shaft 110 into the gear shaft support bearing 112 provided in the cylinder block main body part 68 from the front side so as to rotatably support the lower intermediate gear 28. Next, the upper intermediate gear 30 is inserted through the gear installation opening 40 in the gear chamber 38 so that both intermediate gears 30, 28 meshes with each other. The upper intermediate gear 28 is rotatably supported by the gear support shaft 110 which has been inserted into the gear shaft support bearing 112 provided on the cylinder block main body part 68 from the front side.

Then, the lid member 106 is sealingly attached to the molding removing opening 104 of the cylinder block lower part 70 by a screw 106*a*. Further, the rear ball bearing 76, the front ball bearing 76, and the crank gear 24 are mounted on the crankshaft 22 to which the connecting rod 42 has been attached ahead of time. Then, after locating the two front and rear ball bearings 76, 76 into the ball bearing receiving holes 108, 108 of the cylinder block main body part 68 and locating the crank gear 24 into the gear chamber 38, the cylinder block lower part 70 is firmly fixed to the cylinder block main body part 68 by a suitable number of bolts as illustrated.

Figure 4:
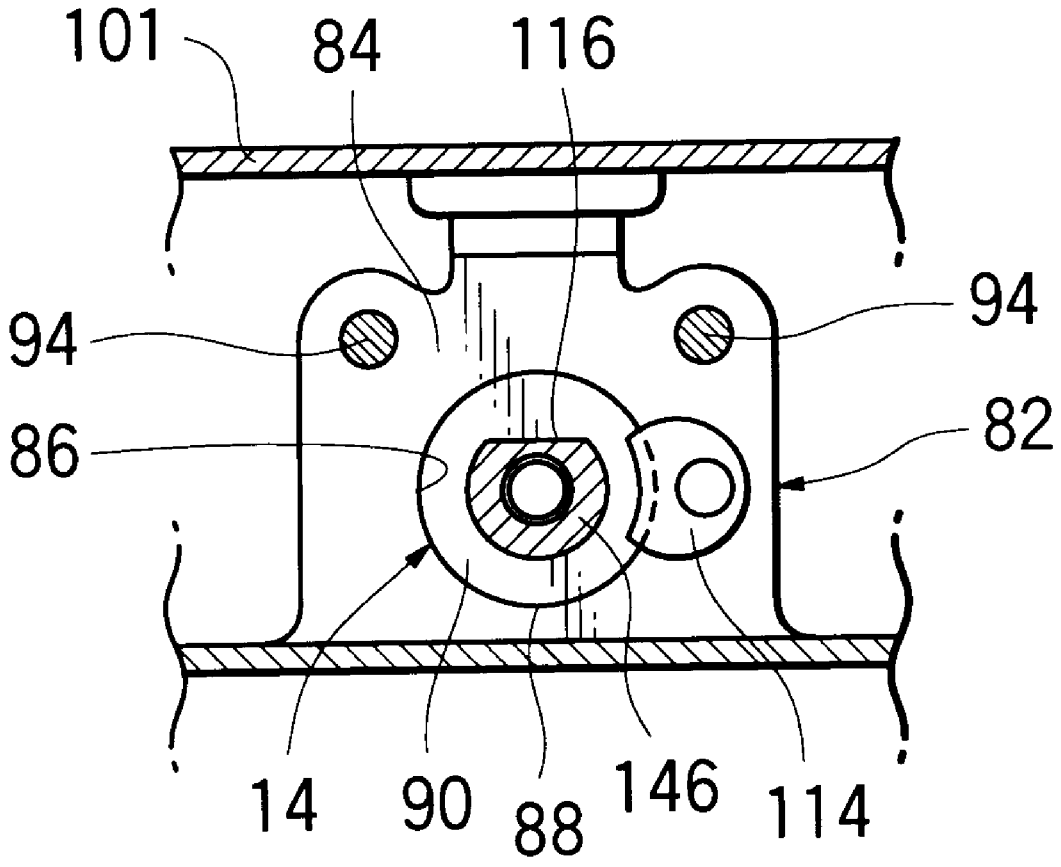
FIG. 4 is a cross-sectional view taken along a line IV—IV shown in FIG. 3, illustrating how a camshaft is attached to a camshaft support portion .

Now, the worker inserts his/her hands into an assembly space in the vicinity of the front camshaft bearing 88 and the gear installation opening 40 to insert the camshaft 14, to which the two cams 20 have already been attached, into the front camshaft bearing 88. Then, the rear end 14*a* of the camshaft 14 is inserted into the rear camshaft bearing 87 located at the innermost portion of the lateral hole 86 and the large diameter support portion 90 of the camshaft 14 is located in the front camshaft bearing 88. Then, a partially-eclipsed moon shaped washer 114 as shown in FIG. 4, is attached to the camshaft support portion 82 so that a portion thereof overlaps with a front surface portion of the large diameter support portion 90, whereby the movement of the camshaft 14 in the elongate direction with respect to the camshaft axis is prevented. In order to prevent the cam gear 26 from rotating with respect to the camshaft 14, a retainer portion 116 extending in the camshaft axis direction is formed at the front end portion 14*b* of the camshaft 14. Further, the worker inserts his/her hands into the above-stated assembly space and locates the cam gear 26 and the upper intermediate gear 30 while adjusting the engagement therebetween. Then the cam gear 26 is coaxially attached to the camshaft 14. Finally, the two rocker arms 92 are attached to the two rocker shafts 94, respectively while maintaining the engagement between each of the two rocker arms 92 and the two cams 20.

The four-stroke cycle internal combustion engine 6 of the present preferred embodiment is of the air-cooled type. Therefore, it has fewer restrictions regarding the molding process because it only needs to be shaped so as to increase the heat radiation area of the outer surface of the cylinder block main body part 68 and it is not required to form cooling water passages or water jackets.

Further, in the present embodiment, the four-stroke cycle internal combustion engine 6 is of the OHC type and the power from the crankshaft 22 to the camshaft 14 is transmitted via the gear train 32 vertically oriented. Therefore, even if the cylinder portion 34, the gear case 36, the upper outer wall portion 78 and the upper inner wall portion 80 are integrally formed, each component of the four-stroke cycle internal combustion engine 6 can be easily assembled because in gear mechanisms, some play between gears is allowed and the structure thereof is simple. This enables an easy assembly at the locations where access is difficult.

Further, according to the present embodiment, the driving force from the crankshaft 22 is transmitted to the camshaft 14 through the gear train 32. Therefore, the load exerted on the camshaft 14 in a radial direction is less compared with that comprising an OHC type camshaft having an endless belt which requires strong tension by a belt tensioning mechanism. As a result, wear on the camshaft 14 is reduced, and relatively small rigidity of the camshaft support portion 82 is required.

Further, according to the present embodiment, the gear support shaft bearings 112, the bearing receiving holes 108 for the crankshaft 22, and camshaft bearings 87, 88 are integrally formed by a molding process. Therefore, the axes can be accurately located in parallel to each other. Higher assembly accuracy can be achieved when the cylinder block body part 68 is formed by an aluminum alloy die-casting process.

Further, according to the present embodiment, the top portion of the cylinder bore 58 can be efficiently cooled by the air-cooling lateral hole 98 formed between the cylinder portion 34 and the camshaft support portion 82 of the cylinder portion 34.

The present invention has thus been shown and described with reference to specific embodiments. However, it should be noted that the present invention is in no way limited to the details of the described arrangements but changes and modifications may be made without departing from the scope of the appended claims.

For example, in the embodiment described above, the oil mist in the oil reserving area 48 is supplied to the constituting parts of the crankcase 44 and other mechanisms through the oil mist suction port 56 and the slit 54 formed in the inner wall 46. However, if necessary, the oil may be supplied thereto more positively by providing an oil dipper at a lower end of the connecting rod 42 and/or another slit in the inner wall 46 to allow the oil dipper to pass through to agitate the oil in the oil reserving area 48.

In the four-stroke cycle internal combustion engine which takes the tilted or upside down position as in the present embodiment, it is desirable to separate the oil reserving area 48 from the crankcase 44 by the inner wall 46 to provide the oil recess areas 50. However, it is not a requirement to provide the inner wall 46.

I claim:

1. A four-stroke cycle OHC type internal combustion engine, comprising:

a rotatable crankshaft;

a camshaft;

a gear train for transmitting the rotation of said crankshaft to said camshaft; and a housing block, said housing block including a cylinder portion, said gear train being disposed in a longitudinal direction along said cylinder portion, said housing block further including a bearing portion for supporting said crankshaft, an upper outer wall portion extending vertically downward from said cylinder portion to said bearing portion and a longitudinally oriented gear case for housing said gear train;

wherein said housing block is divided into a cylinder block main body part and a cylinder block lower part at said bearing portion of said crankshaft, said cylinder block main body part being formed in one piece including said cylinder portion, upper outer wall portion and gear case.

2. A four-stroke cycle OHC type internal combustion engine in accordance with claim 1, in which said engine is of an air-cooled type.

3. A four-stroke cycle OHC type internal combustion engine in accordance with claim 1, wherein said cylinder block main body part further comprises a camshaft support portion for supporting said camshaft, said camshaft support portion being integrally formed therewith above said cylinder portion, said camshaft support portion having a lateral hole which defines at least a pair of camshaft bearings; said gear case having a gear installation opening for receiving gears constituting said gear train; and said lateral hole opening toward said gear installation opening.

4. A four-stroke cycle OHC type internal combustion engine in accordance with claim 2, wherein said cylinder block main body part further has a camshaft support portion for supporting said camshaft, said camshaft support portion being integrally formed therewith above said cylinder portion, said camshaft support portion having a lateral hole which defines at least a pair of camshaft bearings; and said gear case having a gear installation opening for receiving gears constituting said gear train; and said lateral hole opening toward said gear installation opening.

5. A four-stroke cycle OHC type internal combustion engine in accordance with claim 3, in which said camshaft bearing which is located closer to said gear installation opening is large enough to allow cam portions of said camshaft to pass there through; and said camshaft has a large diameter support portion to be supported by said camshaft bearing.

6. A four-stroke cycle OHC type internal combustion engine in accordance with claim 4, in which said camshaft bearing which is located closer to said gear installation opening is large enough to allow cam portions of said camshaft to pass therethrough; and said camshaft has a large diameter support portion to be supported by said camshaft bearing.

7. A four-stroke cycle OHC type internal combustion engine in accordance with claim 1, wherein rotational axes of said crankshaft, said camshaft, and said respective gears of said gear train extend parallel to each other; and said cylinder block main body part has parallel holes formed therein to receive said crankshaft, said camshaft, and supporting shafts of said gears.

8. A four-stroke cycle OHC type internal combustion engine in accordance with claim 2, wherein rotational axes of said crankshaft, said camshaft, and said respective gears of said gear train extend parallel to each other; and said cylinder block main body part has parallel holes formed therein to receive said crankshaft, said camshaft, and supporting shafts of said gears.

9. A four-stroke cycle OHC type internal combustion engine in accordance with claim 3, wherein rotational axes of said crankshaft, said camshaft, and said respective gears of said gear train extend parallel to each other; and said cylinder block main body part has parallel holes formed therein to receive said crankshaft, said camshaft, and supporting shafts of said gears.

10. A four-stroke cycle OHC type internal combustion engine in accordance with claim 4, wherein rotational axes of said crankshaft, said camshaft, and said respective gears of said gear train extend parallel to each other; and said cylinder block main body part has parallel holes formed therein to receive said crankshaft, said camshaft, and supporting shafts of said gears.

11. A four-stroke cycle OHC type internal combustion engine in accordance with claim 5, wherein rotational axes of said crankshaft, said camshaft, and said respective gears of said gear train extend parallel to each other; and said cylinder block main body part has parallel holes formed therein to receive said crankshaft, said camshaft, and supporting shafts of said gears.

12. A four-stroke cycle OHC type internal combustion engine in accordance with claim 6, wherein rotational axes of said crankshaft, said camshaft, and said respective gears of said gear train extend parallel to each other; and said cylinder block main body part has parallel holes formed therein to receive said crankshaft, said camshaft, and supporting shafts of said gears.

* * * * *